US006314747B1

(12) United States Patent
Wightman

(10) Patent No.: US 6,314,747 B1
(45) Date of Patent: Nov. 13, 2001

(54) VAPOR COMPRESSION SYSTEM AND METHOD

(75) Inventor: David A. Wightman, Prospect Heights, IL (US)

(73) Assignee: XDX, LLC, Wheeling, IL (US)

( * ) Notice: Subject to any disclaimer, the term of this patent is extended or adjusted under 35 U.S.C. 154(b) by 0 days.

(21) Appl. No.: 09/228,696

(22) Filed: Jan. 12, 1999

(51) Int. Cl.[7] ..... F25B 41/00

(52) U.S. Cl. ..... 62/196.4; 62/205; 62/222; 62/527; 236/92 B

(58) Field of Search ..... 62/196.4, 205, 62/206, 222, 527; 236/92 B

(56) References Cited

U.S. PATENT DOCUMENTS

| | | |
|---|---|---|
| 2,084,755 | 6/1937 | Young, Jr. . |
| 2,112,039 | 3/1938 | McLenegan . |
| 2,126,364 | 8/1938 | Witzel . |

(List continued on next page.)

FOREIGN PATENT DOCUMENTS

| | | |
|---|---|---|
| WO 95/03515 | 2/1995 | (DE) . |
| 197 52 259 A1 * | 6/1998 | (DE) . |
| 197 43 734 A1 | 4/1999 | (DE) . |
| 0 355 180 A2 | 2/1990 | (EP) . |
| 0355180 | 2/1990 | (EP) . |
| 58146778 | 9/1983 | (JP) . |
| 03020577 | 1/1991 | (JP) . |
| 10325630 | 8/1998 | (JP) . |
| 10306958 | 11/1998 | (JP) . |
| WO 93/06422 | 4/1993 | (WO) . |
| WO 98/03827 | 1/1998 | (WO) . |
| WO 98/57104 | 12/1998 | (WO) . |

OTHER PUBLICATIONS

03304466; Hiroshi et al.; Air Conditioner; Nov. 15, 1990; Pub. No.: 02–279966; p. 156.
02979575; Tadashi et al.; Refrigerating Cycle; Nov. 7, 1989; Pub. No. 01–277175; p. 46.
04001275; Tomomi et al.; Air Conditioner; Dec. 18, 1992; Pub. No. 04–366375; p. 69.
Kominkiewicz, Frank, Memo, dated Feb. 17, 2000, Subject "Tecogen Chiller", 6 pages.
Vienna–Tyler Dec. Case, Memo, dated Feb. 25, 2000, Compressor Model D6VD12, Serial N159282.

*Primary Examiner*—Harry B. Tanner
(74) *Attorney, Agent, or Firm*—Brinks, Hofer, Gilson & Lione

(57) ABSTRACT

A vapor compression refrigeration system includes an evaporator, a compressor, and a condenser interconnected in a closed-loop system. In one embodiment, a multifunctional valve is configured to receive a liquefied heat transfer fluid from the condenser and a hot vapor from the compressor. A saturated vapor line connects the outlet of the multifunctional valve to the inlet of the evaporator and is sized so as to substantially convert the heat transfer fluid exiting the multifunctional valve into a saturated vapor prior to delivery to the evaporator. The multifunctional valve regulates the flow of heat transfer fluid through the valve by monitoring the temperature of the heat transfer fluid returning to the compressor through a suction line coupling the outlet of the evaporator to the inlet of the compressor. Separate gated passageways within the multifunctional valve permit the refrigeration system to be operated in defrost mode by flowing hot vapor through the saturated vapor line and the evaporator in a forward-flow process thereby reducing the amount of time necessary to defrost the system and improving the overall system performance.

41 Claims, 5 Drawing Sheets

U.S. PATENT DOCUMENTS

| | | | | |
|---|---|---|---|---|
| 2,164,761 | | 7/1939 | Ashley . | |
| 2,200,118 | | 5/1940 | Miller . | |
| 2,229,940 | | 1/1941 | Spofford . | |
| 2,323,408 | | 7/1943 | Miller . | |
| 2,471,448 | | 5/1949 | Platon | 62/115 |
| 2,511,565 | | 6/1950 | Carter | 62/8 |
| 2,520,191 | | 8/1950 | Aughey et al. | 62/8 |
| 2,539,062 | | 1/1951 | Dillman | 62/8 |
| 2,547,070 | | 4/1951 | Aughey et al. | 62/127 |
| 2,571,625 | | 10/1951 | Seldon | 62/8 |
| 2,596,036 | | 5/1952 | MacDougall . | |
| 2,707,868 | | 5/1955 | Goodman . | |
| 2,755,025 | | 7/1956 | Boles | 236/92 |
| 2,771,092 | | 11/1956 | Schenk | 137/561 |
| 2,856,759 | | 10/1958 | Barbulesco | 62/211 |
| 2,922,292 | | 1/1960 | Lange | 62/203 |
| 2,944,411 | | 7/1960 | McGrath . | |
| 2,960,845 | | 11/1960 | Lange . | |
| 3,014,351 | * | 12/1961 | Leimbach | 62/197 |
| 3,060,699 | * | 10/1962 | Tilney | 62/196 |
| 3,138,007 | | 6/1964 | Friedman et al. . | |
| 3,150,498 | | 9/1964 | Blake . | |
| 3,194,499 | | 7/1965 | Noakes et al. | 236/92 |
| 3,316,731 | | 5/1967 | Quick . | |
| 3,343,375 | | 9/1967 | Quick . | |
| 3,392,542 | | 7/1968 | Nussbaum . | |
| 3,402,566 | | 9/1968 | Leimbach | 62/197 |
| 3,427,819 | | 2/1969 | Seghetti . | |
| 3,464,226 | | 9/1969 | Kramer . | |
| 3,520,147 | | 7/1970 | Glackman . | |
| 3,631,686 | | 1/1972 | Kautz . | |
| 3,633,378 | | 1/1972 | Toth . | |
| 3,638,444 | | 2/1972 | Lindahl . | |
| 3,638,447 | | 2/1972 | Abe . | |
| 3,683,637 | | 8/1972 | Oshima et al. | 62/225 |
| 3,708,998 | | 1/1973 | Scherer et al. | 62/275 |
| 3,727,423 | | 4/1973 | Nielson . | |
| 3,785,163 | | 1/1974 | Wagner | 62/77 |
| 3,792,594 | | 2/1974 | Kramer . | |
| 3,798,920 | | 3/1974 | Morgan . | |
| 3,822,562 | | 7/1974 | Crosby . | |
| 3,866,427 | | 2/1975 | Rothmayer et al. | 62/7 |
| 3,921,413 | | 11/1975 | Kohlbeck . | |
| 3,934,424 | | 1/1976 | Goldsberry | 62/87 |
| 3,934,426 | * | 1/1976 | Jespersen et al. | 62/205 |
| 3,948,060 | | 4/1976 | Gaspard . | |
| 3,967,466 | | 7/1976 | Edwards | 62/402 |
| 3,967,782 | | 7/1976 | Eschbaugh et al. | 236/92 |
| 3,968,660 | | 7/1976 | Amann et al. | 62/275 |
| 3,980,129 | | 9/1976 | Bergdahl | 165/17 |
| 4,003,729 | | 1/1977 | McGrath . | |
| 4,003,798 | | 1/1977 | McCord | 202/160 |
| 4,006,601 | | 2/1977 | Ballarin et al. | 62/80 |
| 4,103,508 | | 8/1978 | Apple . | |
| 4,106,691 | | 8/1978 | Nielsen | 236/92 |
| 4,122,686 | | 10/1978 | Lindahl et al. . | |
| 4,122,688 | | 10/1978 | Mochizuki et al. . | |
| 4,136,528 | * | 1/1979 | Vogel et al. | 62/174 |
| 4,151,722 | | 5/1979 | Willitts et al. . | |
| 4,163,373 | | 8/1979 | van der Sluijs | 62/279 |
| 4,167,102 | | 9/1979 | Willitts | 62/152 |
| 4,176,525 | * | 12/1979 | Tucker et al. | 62/238 R |
| 4,182,133 | | 1/1980 | Haas et al. . | |
| 4,184,341 | | 1/1980 | Friedman . | |
| 4,193,270 | | 3/1980 | Scott . | |
| 4,207,749 | | 6/1980 | Lavigne, Jr. | 62/115 |
| 4,230,470 | | 10/1980 | Matsuda et al. . | |
| 4,235,079 | | 11/1980 | Masser | 62/87 |
| 4,270,362 | | 6/1981 | Lancia et al. . | |
| 4,285,205 | | 8/1981 | Martin et al. . | |
| 4,290,480 | | 9/1981 | Sulkowski . | |
| 4,302,945 | | 12/1981 | Bell | 62/81 |
| 4,328,682 | | 5/1982 | Vana . | |
| 4,350,021 | | 9/1982 | Lundström | 62/150 |
| 4,398,396 | | 8/1983 | Schmerzler | 62/116 |
| 4,430,866 | | 2/1984 | Willitts . | |
| 4,451,273 | | 5/1984 | Cheng et al. | 62/12 |
| 4,485,642 | | 12/1984 | Karns . | |
| 4,493,364 | | 1/1985 | Macriss et al. | 165/1 |
| 4,543,802 | | 10/1985 | Ingelmann et al. . | |
| 4,583,582 | | 4/1986 | Grossman | 165/32 |
| 4,596,123 | | 6/1986 | Cooperman | 62/199 |
| 4,606,198 | | 8/1986 | Latshaw et al. . | |
| 4,621,505 | | 11/1986 | Ares et al. . | |
| 4,633,681 | | 1/1987 | Webber | 62/511 |
| 4,658,596 | | 4/1987 | Kuwahara . | |
| 4,660,385 | | 4/1987 | Macriss et al. | 62/57 |
| 4,742,694 | | 5/1988 | Yamanaka et al. . | |
| 4,779,425 | | 10/1988 | Yoshihisa et al. . | |
| 4,813,474 | | 3/1989 | Umezu . | |
| 4,848,100 | | 7/1989 | Barthel et al. | 62/212 |
| 4,852,364 | | 8/1989 | Seener et al. | 62/225 |
| 4,854,130 | | 8/1989 | Naruse et al. . | |
| 4,888,957 | | 12/1989 | Chmielewski | 62/84 |
| 4,938,032 | | 7/1990 | Mudford . | |
| 4,942,740 | | 7/1990 | Shaw et al. . | |
| 4,947,655 | | 8/1990 | Shaw . | |
| 4,955,205 | | 9/1990 | Wilkinson . | |
| 4,955,207 | | 9/1990 | Mink . | |
| 4,979,372 | | 12/1990 | Tanaka | 62/225 |
| 4,984,433 | | 1/1991 | Worthington . | |
| 5,050,393 | | 9/1991 | Bryant | 62/115 |
| 5,058,388 | | 10/1991 | Shaw et al. . | |
| 5,062,276 | | 11/1991 | Dudley . | |
| 5,065,591 | | 11/1991 | Shaw . | |
| 5,070,707 | * | 12/1991 | Ni | 62/234 |
| 5,072,597 | | 12/1991 | Bromley et al. . | |
| 5,076,068 | | 12/1991 | Mikhail | 62/215 |
| 5,094,598 | | 3/1992 | Amata et al. . | |
| 5,107,906 | | 4/1992 | Swenson et al. | 141/11 |
| 5,129,234 | | 7/1992 | Alford . | |
| 5,131,237 | | 7/1992 | Valbjorn . | |
| 5,168,715 | * | 12/1992 | Nakao et al. | 62/181 |
| 5,181,552 | | 1/1993 | Eiermann . | |
| 5,231,845 | | 8/1993 | Sumitani et al. . | |
| 5,249,433 | | 10/1993 | Hardison et al. | 62/282 |
| 5,251,459 | | 10/1993 | Grass et al. | 62/324 |
| 5,253,482 | | 10/1993 | Murway | 62/175 |
| 5,291,941 | * | 3/1994 | Enomoto et al. | 165/62 |
| 5,303,561 | | 4/1994 | Bahel et al. . | |
| 5,305,610 | | 4/1994 | Bennett et al. | 62/5 |
| 5,309,725 | | 5/1994 | Cayce . | |
| 5,329,781 | | 7/1994 | Farrey et al. | 62/82 |
| 5,355,323 | | 10/1994 | Bae . | |
| 5,377,498 | | 1/1995 | Cur et al. . | |
| 5,408,835 | | 4/1995 | Anderson | 62/82 |
| 5,423,480 | | 6/1995 | Heffner et al. | 236/92 |
| 5,440,894 | | 8/1995 | Schaeffer et al. . | |
| 5,509,272 | | 4/1996 | Hyde . | |
| 5,515,695 | | 5/1996 | Sakakibara et al. . | |
| 5,520,004 | | 5/1996 | Jones, III | 62/63 |
| 5,544,809 | | 8/1996 | Keating et al. . | |
| 5,586,441 | | 12/1996 | Wilson et al. | 62/99 |
| 5,597,117 | | 1/1997 | Watanabe et al. | 236/92 |
| 5,598,715 | | 2/1997 | Edmisten . | |
| 5,615,560 | | 4/1997 | Inoue | 62/212 |
| 5,622,055 | | 4/1997 | Mei et al. . | |
| 5,622,057 | | 4/1997 | Bussjager et al. . | |
| 5,634,355 | | 6/1997 | Cheng et al. | 62/632 |
| 5,651,258 | | 7/1997 | Harris . | |
| 5,678,417 | | 10/1997 | Nigo et al. . | |

5,689,962 11/1997 Rafalovich .
5,692,387 12/1997 Alsenz et al. .
5,694,782 12/1997 Alsenz .
5,706,665 1/1998 Gregory .
5,706,666 1/1998 Yamanaka et al. ..... 62/225
5,743,100 4/1998 Welguisz et al. .
5,752,390 5/1998 Hyde ..... 62/196.4
5,765,391 6/1998 Lee et al. .
5,806,321 9/1998 Bendtsen et al. .
5,813,242 9/1998 Lawrence et al. .
5,826,438 10/1998 Ohishi et al. .
5,839,505 11/1998 Ludwig et al. .
5,842,352 12/1998 Gregory .
5,845,511 12/1998 Okada et al. .
5,850,968 12/1998 Jokinen .
5,862,676 1/1999 Kim et al. ..... 62/197
5,867,998 2/1999 Guertin ..... 62/225
5,964,099 10/1999 Kim ..... 62/324.6
5,987,916 11/1999 Egbert .

* cited by examiner

VAPOR COMPRESSION SYSTEM AND METHOD

FIELD OF THE INVENTION

This invention relates, generally, to vapor compression refrigeration systems, and more particularly, to mechanically-controlled refrigeration systems using forward-flow defrost cycles.

BACKGROUND OF THE INVENTION

In a closed-loop vapor compression cycle, the heat transfer fluid changes state from a vapor to a liquid in the condenser, giving off heat, and changes state from a liquid to a vapor in the evaporator, absorbing heat during vaporization. A typical vapor-compression refrigeration system includes a compressor for pumping a heat transfer fluid, such as a freon, to a condenser, where heat is given off as the vapor condenses into a liquid. The liquid flows through a liquid line to a thermostatic expansion valve, where the heat transfer fluid undergoes a volumetric expansion. The expanded heat transfer fluid then flows into an evaporator, where the liquid refrigerant is vaporized at a low pressure absorbing heat while it undergoes a change of state from a liquid to a vapor. The heat transfer fluid, now in the vapor state, flows through a suction line back to the compressor.

In one aspect, the efficiency of the vapor-compression cycle depends upon the ability of the system to maintain the heat transfer fluid as a high pressure liquid upon exiting the condenser. The cooled, high-pressure liquid must remain in the liquid state over the long refrigerant lines extending between the condenser and the thermostatic expansion valve. The proper operation of the thermostatic expansion valve depends upon a certain volume of liquid heat transfer fluid passing through the valve. As the high-pressure liquid passes through an orifice in the thermostatic expansion valve, the fluid undergoes a pressure drop as the fluid expands through the valve. At the lower pressure, the fluid cools as it passes into the initial portion of cooling coils within the evaporator. As the fluid progresses through the coils, it absorbs heat from the ambient surroundings and begins to boil. The boiling process within the evaporator coils produces a saturated vapor within the coils that continues to absorb heat from the ambient surroundings. Once the fluid is completely boiled-off, it exits through the final stages of the cooling coil as a cold vapor. Once the fluid is completely converted to a cold vapor, it absorbs very little heat. The cooled vapor is then returned through a suction line to the compressor, where the vapor-compression cycle continues.

For high-efficiency operation, the heat transfer fluid should change state from a liquid to a vapor in a large portion of the cooling coils within the evaporator. As the heat transfer fluid changes state from a liquid to a vapor, it absorbs a great deal of energy as the molecules change from a liquid to a gas absorbing a latent heat of vaporization. In contrast, relatively little heat is absorbed while the fluid is in the liquid state or while the fluid is in the vapor state. Thus, optimum cooling efficiency depends on precise control of the heat transfer fluid by the thermostatic expansion valve to insure that the fluid undergoes a change of state in as large of cooling coil length as possible.

The thermostatic expansion valve plays an important role and regulating the flow of heat transfer fluid through the closed-loop system. Before any cooling effect can be produced in the evaporator, the heat transfer fluid has to be cooled to an evaporating temperature. The flow of low pressure liquid to the evaporator is metered by the thermostatic expansion valve in an attempt to maintain maximum cooling efficiency in the evaporator. Typically, a mechanical thermostatic expansion valve regulates the flow of heat transfer fluid by monitoring the temperature of the heat transfer fluid in the suction line near the outlet of the evaporator. A temperature sensor is attached to the suction line to measure the amount of superheating experienced by the heat transfer fluid as it exits from the evaporator. Superheat is the amount of heat added to the vapor, after the heat transfer fluid has completed boiled-off and liquid no longer remains in the suction line. Since very little heat is absorbed by the superheated vapor, the thermostatic expansion valve meters the flow of heat transfer fluid to minimize the amount of superheated vapor formed in the evaporator. Accordingly, the thermostatic expansion valve determines the amount of low-pressure liquid flowing into the evaporator by monitoring the degree of superheating of the vapor exiting from the evaporator.

In addition to the need to regulate the flow of heat transfer fluid through the closed-loop system, the optimum operating efficiency of the refrigeration system depends upon periodic defrost of the evaporator. Periodic defrosting of the evaporator is needed to remove icing that develops on the evaporator coils during operation. As ice or frost develops over the evaporator, it impedes the passage of air over the evaporator coils reducing the heat transfer efficiency. In a commercial system, such as a refrigerated display cabinet, the build up of frost can reduce the rate of air flow to such an extent that an air curtain cannot form in the display cabinet. In commercial systems, such as food chillers, and the like, it is often necessary to defrost the evaporator every few hours. Various defrosting methods exist, such as off-cycle methods, where the refrigeration cycle is stopped and the evaporator is defrosted by air at ambient temperatures. Additionally, electrical defrost off-cycle methods are used, where electrical heating elements are provided around the evaporator and electrical current is passed through the heating coils to melt the frost.

In addition to off-cycle defrost systems, refrigeration systems have been developed that rely on the relatively high temperature of the heat transfer fluid exiting the compressor to defrost the evaporator. In these techniques, the high-temperature vapor is routed directly from the compressor to the evaporator. In one technique, the flow of high temperature vapor is dumped into the suction line and the system is essentially operated in reverse. In other techniques, the high-temperature vapor is pumped into a dedicated line that leads directly from the compressor to the evaporator for the sole purpose of conveying high-temperature vapor to periodically defrost the evaporator. Additionally, other complex methods have been developed that rely on numerous devices within the refrigeration system, such as bypass valves, bypass lines, heat exchangers, and the like.

In an attempt to obtain better operating efficiency from conventional vapor-compression refrigeration systems, the refrigeration industry developing systems of growing complexity. Sophisticated computer-controlled thermostatic expansion valves have been developed in an attempt to obtain better control of the heat transfer fluid through the evaporator. Additionally, complex valves and piping systems have been developed to more rapidly defrost the evaporator in order to maintain high heat transfer rates. While these systems have achieved varying levels of success, the system cost rises dramatically as the complexity of the system increases. Accordingly, a need exists for a efficient refrigeration system that can be installed at low cost and operated at high efficiency.

SUMMARY OF THE INVENTION

The present invention provides a refrigeration system that maintains high operating efficiency by feeding a saturated vapor into the inlet of an evaporator. By feeding saturated vapor to the evaporator, very little heat transfer fluid in the liquid state enters the evaporator coils. Thus, the heat transfer fluid is delivered to the evaporator in a physical state in which maximum heat can be absorbed by the fluid. In addition to high efficiency operation of the evaporator, the refrigeration system of the invention provides a simple means of defrosting the evaporator. A multifunctional valve is employed that contains separate passageways feeding into a common chamber. In operation, the multifunctional valve can transfer either a saturated vapor, for cooling, or a high temperature vapor, for defrosting, to the evaporator.

In one form, the vapor compression system includes an evaporator for evaporating a heat transfer fluid, a compressor for compressing the heat transfer fluid to a relatively high temperature and pressure, and a condenser for condensing the heat transfer fluid. A saturated vapor line is coupled from an expansion valve to the evaporator. The diameter and the length of the saturated vapor line is sufficient to insure substantial conversion of the heat transfer fluid into a saturated vapor prior to delivery of the fluid to the evaporator. In one embodiment of the invention, the expansion valve resides within a multifunctional valve that includes a first inlet for receiving the heat transfer fluid in the liquid state, and a second inlet for receiving the heat transfer fluid in the vapor state. The multifunctional valve further includes passageways coupling the first and second inlets to a common chamber. Gate valves position within the passageways enable the flow of heat transfer fluid to be independently interrupted in each passageway. The ability to independently control the flow of saturated vapor and high temperature vapor through the refrigeration system produces high operating efficiency by both increased heat transfer rates at the evaporator and by rapid defrosting of the evaporator. The increased operating efficiency enables the refrigeration system to be charged with relatively small amounts of heat transfer fluid, yet the refrigeration system can handle relatively large thermal loads.

DETAILED DESCRIPTION OF THE PREFERRED EMBODIMENTS

Figure 1:
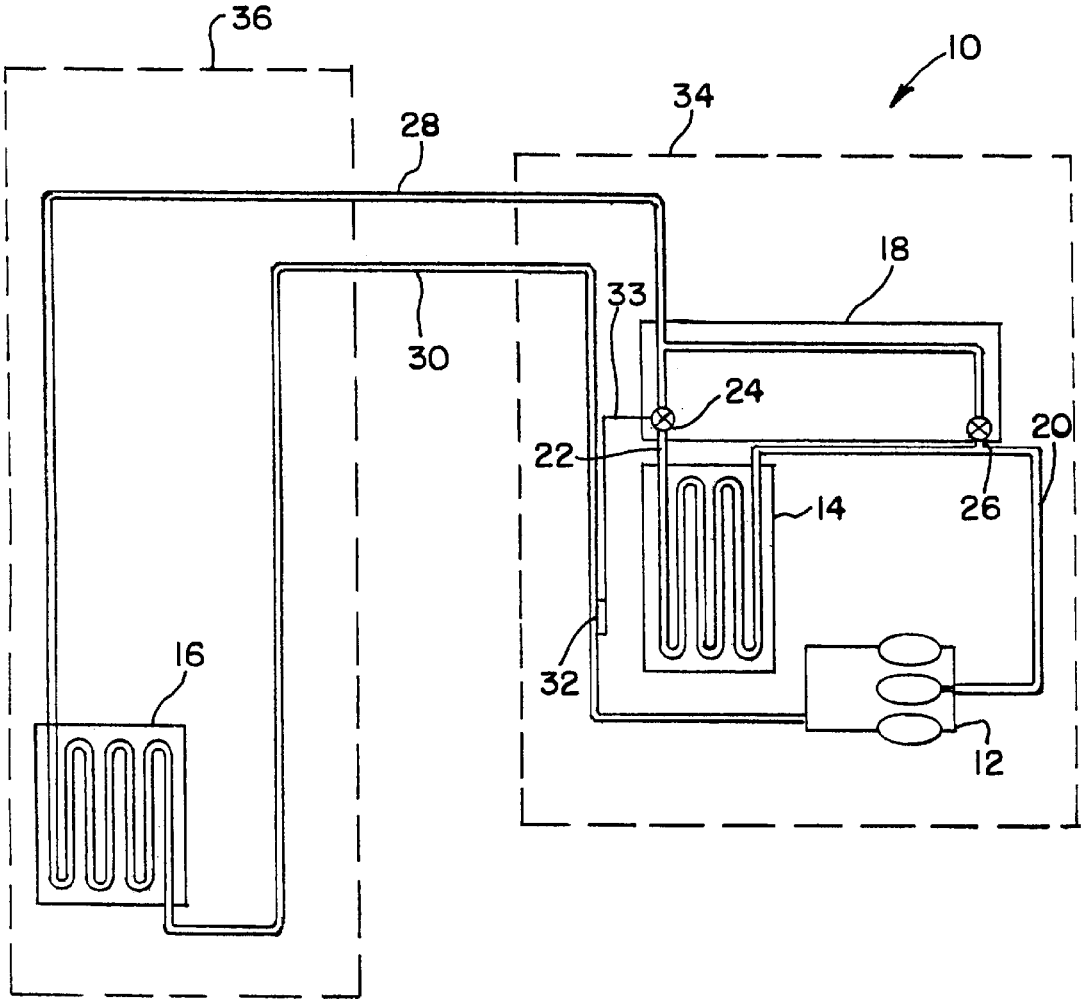
FIG. 1 is a schematic drawing of a vapor-compression system arranged in accordance with one embodiment of the invention.

An embodiment of a vapor-compression system 10 arranged in accordance with one embodiment of the invention is illustrated in FIG. 1. Refrigeration system 10 includes a compressor 12, a condenser 14, an evaporator 16, and a multifunctional valve 18. Compressor 12 is coupled to condenser 14 by a discharge line 20. Multifunctional valve 18 is coupled to condenser 14 by a liquid line 22 coupled to a first inlet 24 of multifunctional valve 18. Additionally, multifunctional valve 18 is coupled to discharge line 20 at a second inlet 26. A saturated vapor line 28 couples multifunctional valve 18 to evaporator 16, and a suction line 30 couples the outlet of evaporator 16 to the inlet of compressor 12. A temperature sensor 32 is mounted to suction line 30 and is operably connected to multifunctional valve 18. In accordance with the invention, compressor 12, condenser 14, multifunctional valve 18 and temperature sensor 32 are located within a control unit 34. Correspondingly, evaporator 16 is located within a refrigeration case 36.

The vapor compression system of the present invention can utilize essentially any commercially available heat transfer fluid including refrigerants such as those chloroflourocarbon and chlorofluorohydrocarbon refrigerants known as R-12, R-22, R-134a, azeotropic refrigerants such as R-500, and nonazeotropic refrigerant mixtures of R-32 and R-22, with refrigerants R-134 and R-152a. The particular refrigerant or combination of refrigerants utilized in the present invention is not deemed to be critical to the operation of the present invention since the present invention is expected to operate with a greater system efficiency than achievable in any previously known vapor compression system utilizing the same refrigerant.

In operation, compressor 12 compresses the heat transfer fluid, to a relatively high pressure and temperature. The temperature and pressure to which the heat transfer fluid is compressed by compressor 12 will depend upon the particular size of refrigeration system 10 and the cooling load requirements of the systems. Compressor 12 pumps the heat transfer fluid into discharge line 20 and into condenser 14. As will be described in more detail below, during cooling operations, second inlet 26 is closed and the entire output of compressor 12 is pumped through condenser 14.

In condenser 14, a medium such as air or water, is blown past coils within the condenser causing the pressurized heat transfer fluid to change to the liquid state. The temperature of the heat transfer fluid drops about 10 to 40° F. (5.6 to 22.2° C.), depending on the particular heat transfer fluid, or glycol, or the like, as the latent heat within the fluid is expelled during the condensation process. Condenser 14 discharges the liquefied heat transfer fluid to liquid line 22. As shown in FIG. 1, liquid line 22 immediately discharges into multifunctional valve 18. Because liquid line 22 is relatively short, the pressurized liquid carried by liquid line 22 does not substantially increase in temperature as it passes from condenser 14 to multifunctional valve 18. By configuring refrigeration system 10 to have a short liquid line, refrigeration system 10 advantageously delivers substantial amounts of heat transfer fluid to multifunctional valve 18 at a low temperature and high pressure. Since the fluid does not travel a great distance once it is converted to a high-pressure liquid, little heat absorbing capability is lost by the inadvertent warming of the liquid before it enters multifunctional valve 18, or by a loss of in liquid pressure.

The heat transfer fluid discharged by condenser 14 enters multifunctional valve 18 at first inlet 22 and undergoes a volumetric expansion at a rate determined by the temperature of suction line 30 at temperature sensor 32. Multifunctional valve 18 discharges the heat transfer fluid as a saturated vapor into saturated vapor line 28. Temperature sensor 32 relays temperature information through a control line 33 to multifunctional valve 18.

Those skilled in the art will recognize that refrigeration system 10 can be used in a wide variety of applications for controlling the temperature of an enclosure, such as a refrigeration case in which perishable food items are stored. For example, where refrigeration system 10 is employed to control the temperature of a refrigeration case having a cooling load of about 12000 Btu/hr (84 g cal/s), compressor 12 discharges about 3 to 5 lbs/min (1.36 to 2.27 kg/min) of R-12 at a temperature of about 110° F. (43.3° C.) to about 120° F. (48.9° C.) and a pressure of about 150 lbs/in$^2$ (1.03 E5 N/m$^2$) to about 180 lbs/in.$^2$ (1.25 E5 N/m$^2$)

In accordance with the invention, saturated vapor line 28 is sized in such a way that the low pressure fluid discharged into saturated vapor line 28 substantially converts to a saturated vapor as it travels through saturated vapor line 28. In one embodiment, saturated vapor line 28 is sized to handle about 2500 ft/min (76 m/min) to 3700 ft/min (1128 m/min) of a heat transfer fluid, such as R-12, and the like, and has a diameter of about 0.5 to 1.0 inches (1.27 to 2.54 cm), and a length of about 90 to 100 feet (27 to 30.5 m). As described in more detail below, multifunctional valve 18 includes a common chamber immediately before the outlet. The heat transfer fluid undergoes an additional volumetric expansion as it enters the common chamber. The additional volumetric expansion of the heat transfer fluid in the common chamber of multifunctional valve 18 is equivalent to an effective increase in the line size of saturated upon line 28 by about 225%.

Those skilled in the art will further recognize that the positioning of a valve for volumetrically expanding of the heat transfer fluid in close proximity to the condenser, and the relatively great length of the fluid line between the point of volumetric expansion and the evaporator, differs considerably from systems of the prior art. In a typical prior art system, an expansion valve is positioned immediately adjacent to the inlet of the evaporator, and if a temperature sensing device is used, the device is mounted in close proximity to the outlet of the evaporator. As previously described, such system can suffer from poor efficiency because substantial amounts of the evaporator carry a liquid rather than a saturated vapor.

In contrast to the prior art, the inventive refrigeration system described herein positions a saturated vapor line between the point of volumetric expansion and the inlet of the evaporator, such that substantial portions of the heat transfer fluid are converted to a saturated vapor before the heat transfer fluid enters the evaporator. By charging evaporator 16 with a saturated vapor, the cooling efficiency is greatly increased. By increasing the cooling efficiency of an evaporator, such as evaporator 16, numerous benefits are realized by the refrigeration system. For example, less heat transfer fluid is needed to control the air temperature of refrigeration case 36 at a desired level. Additionally, less electricity is needed to power compressor 12 resulting in lower operating cost. Further, compressor 12 can be sized smaller than a prior art system operating to handle a similar cooling load. Moreover, the refrigeration system of the invention avoids placing numerous components in proximity to the evaporator. By restricting the placement of components within refrigeration case 36 to a minimal number, the thermal loading of refrigeration case 36 is minimized.

Figure 2:
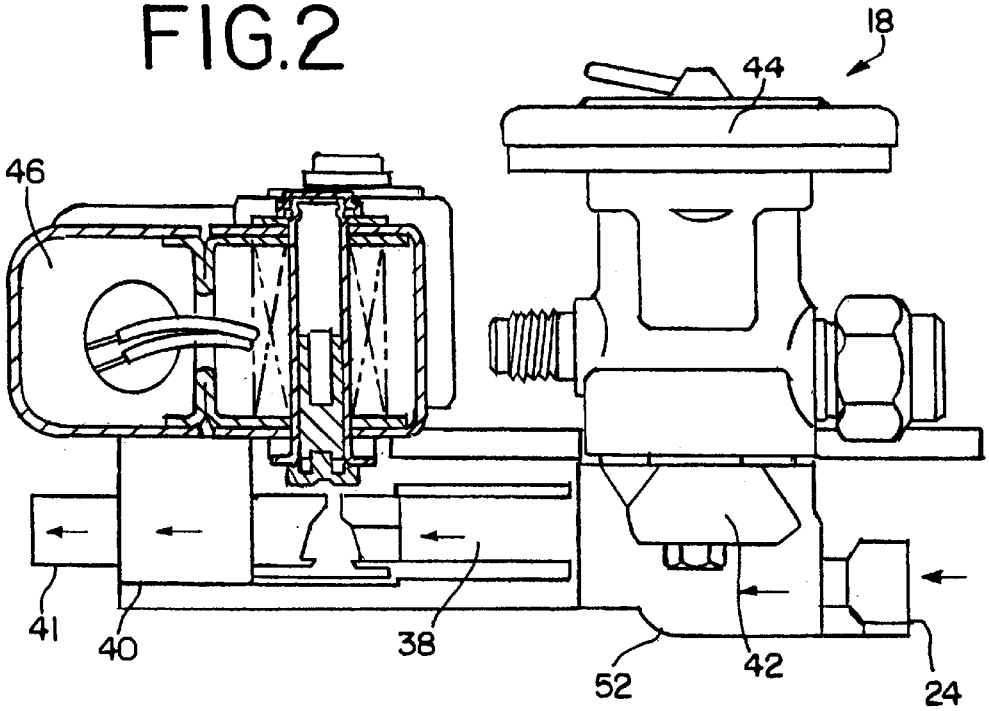
FIG. 2 is a side view, in partial cross-section, of a first side of a multifunctional valve in accordance with one embodiment of the invention.

Shown in FIG. 2 is a side view, in partial cross-section, of one embodiment of multifunctional valve 18. Heat transfer fluid enters first inlet 24 and traverses a first passageway 38 to a common chamber 40. An expansion valve 42 is positioned in first passageway 38 near first inlet 24. Expansion valve 42 meters the flow of the heat transfer fluid through first passageway 38 by means of a diaphragm (not shown) enclosed within an upper valve housing 44. Control line 33 is connected to an input 62 located on upper valve housing 44. Signals relayed through control line 33 activate the diaphragm within upper valve housing 44. The diaphragm actuates a valve assembly 54 shown in FIG. 4 to control the amount of heat transfer fluid entering an expansion chamber 52 shown in FIG. 4 from first inlet 24. A gating valve 46 is positioned in first passageway 38 near common chamber 40. In a preferred embodiment of the invention, gating valve 46 is a solenoid valve capable of terminating the flow of heat transfer fluid through first passageway 38 in response to an electrical signal.

Figure 3:
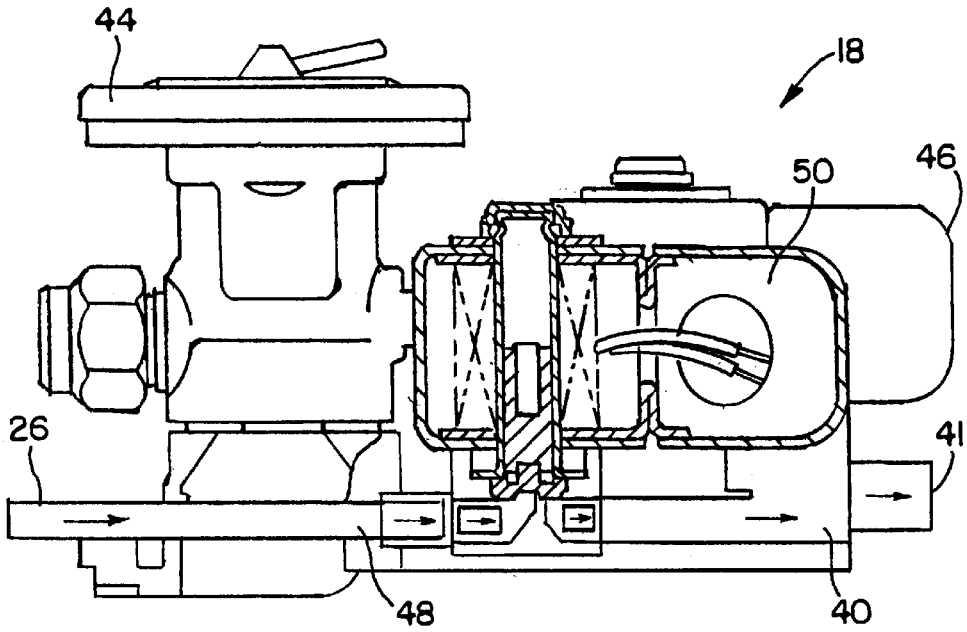
FIG. 3 is a side view, in partial cross-section, of a second side of the multifunctional valve illustrated in FIG. 2.

Shown in FIG. 3 is a side view, in partial cross-section, of a second side of multifunctional valve 18. A second passageway 48 couples second inlet 26 to common chamber 40. A gating valve 50 is positioned in second passageway 48 near common chamber 40. In a preferred embodiment of the invention, gating valve 50 is a solenoid valve capable of terminating the flow of heat transfer fluid through second passageway 48 upon receiving an electrical signal. Common chamber 40 discharges the heat transfer fluid from multifunctional valve 18 through an outlet 41.

Figure 4:
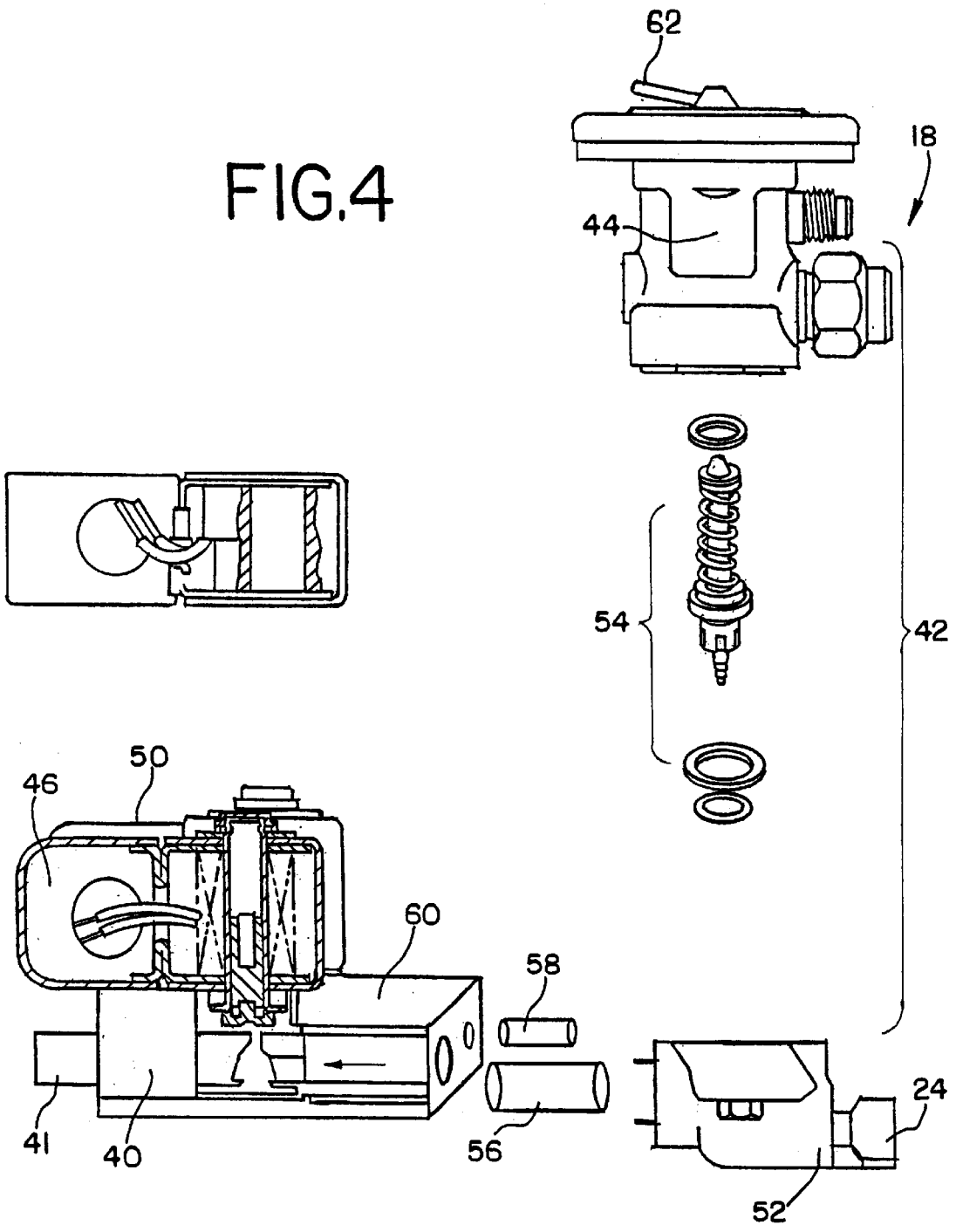
FIG. 4 is an exploded view of a multifunctional valve in accordance with one embodiment of the invention.

An exploded perspective view of multifunctional valve 18 is illustrated in FIG. 4. Expansion valve 42 is seen to include expansion chamber 52 adjacent first inlet 22, valve assembly 54, and upper valve housing 44. Valve assembly 54 is actuated by a diaphragm (not shown) contained within the upper valve housing 44. First and second tubes 56 and 58 are located intermediate to expansion chamber 58 and a valve body 60. Gating valves 46 and 50 are mounted on valve body 60.

In accordance with the invention, refrigeration system 10 can be operated in a defrost mode by closing gating valve 46 and opening gating valve 50. In defrost mode, high temperature heat transfer fluid enters second inlet 26 and traverses second passageway 48 and enters common chamber 40. The high temperature vapors are discharged through outlet 41 and traverse saturated vapor line 28 to evaporator 16. The high temperature vapor has a temperature sufficient to raise the temperature of evaporator 16 by about 50 to 120° F. (27.8 to 66.7° C.). The temperature rise is sufficient to remove frost from evaporator 16 and restore the heat transfer rate to desired operational levels.

During the defrost cycle, any pockets of oil trapped in the system will be warmed and carried in the same direction of flow as the heat transfer fluid. By forcing hot gas through the system in a forward flow direction, the trapped oil will eventually be returned to the compressor. The hot gas will travel through the system at a relatively high velocity, giving the gas less time to cool thereby improving the defrosting efficiency. The forward flow defrost method of the invention offers numerous advantages to a reverse flow defrost method. For example, reverse flow defrost systems employ a small diameter check valve near the inlet of the evaporator. The check valve restricts the flow of hot gas in the reverse direction reducing its velocity and hence its defrosting efficiency. Furthermore, the forward flow defrost method of the invention avoids pressure build up in the system during the defrost system. Additionally, reverse flow methods tend to push oil trapped in the system back into the expansion valve. This is not desirable because excess oil in the expansion can cause gumming that restricts the operation of the valve. Also, with forward defrost, the liquid line pressure is not reduced in any additional refrigeration circuits being operated in addition to the defrost circuit.

It will be apparent to those skilled in the art that a vapor compression system arranged in accordance with the invention can be operated with less heat transfer fluid those comparable sized system of the prior art. By locating the multifunctional valve near the condenser, rather than near the evaporation, the saturated vapor line is filled with a relatively low-density vapor, rather than a relatively high-density liquid. Additionally, prior art systems compensate for low temperature ambient operations (e.g. winter time) by flooding the evaporation in order to reinforce a proper head pressure at the expansion valve. In the inventive vapor compression system heat pressure is more readily maintained in cold weather, since the multifunctional value is positioned in close proximity to the condenser.

The forward flow defrost capability of the invention also offers numerous operating benefits as a result of improved defrosting efficiency. For example, by forcing trapped oil back into the compressor, liquid slugging is avoided, which has the effect of increasing the useful life of the equipment. Furthermore, reduced operating costs are realized because less time is required to defrost the system. Since the flow of hot gas can be quickly terminated, the system can be rapidly returned to normal cooling operation. When frost is removed from evaporator 16, temperature sensor 32 detects a temperature increase in the heat transfer fluid in suction line 30. When the temperature rises to a given set point, gating valve 50 and multifunctional valve 18 is closed. Once the flow of heat transfer fluid through first passageway 38 resumes, cold saturated vapor quickly returns to evaporator 16 to resume refrigeration operation.

Those skilled in the art will appreciate that numerous modifications can be made to enable the refrigeration system of the invention to address a variety of applications. For example, refrigeration systems operating in retail food outlets typically include a number of refrigeration cases that can be serviced by a common compressor system. Also, in applications requiring refrigeration operations with high thermal loads, multiple compressors can be used to increase the cooling capacity of the refrigeration system.

Figure 5:
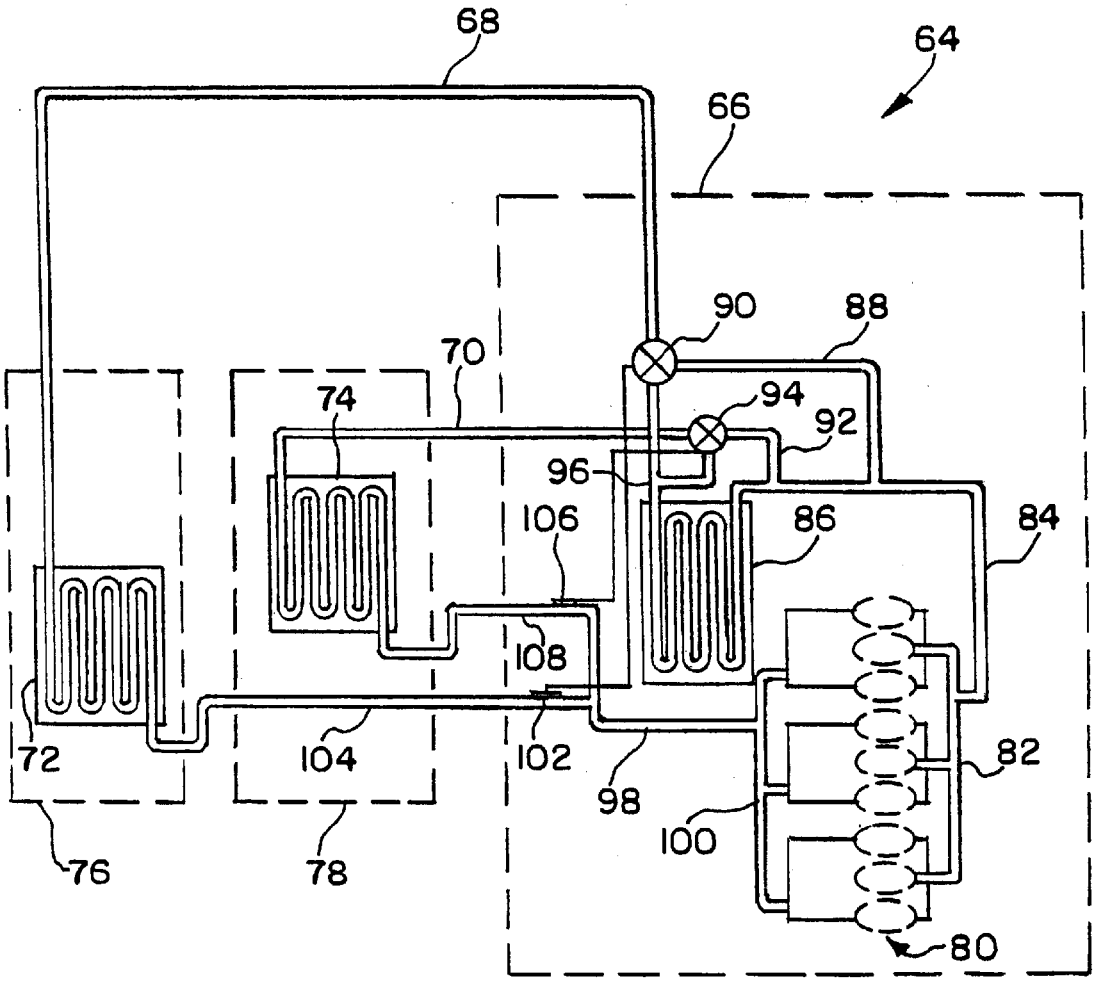
FIG. 5 is a schematic view of a vapor-compression system in accordance with another embodiment of the invention.

A vapor compression refrigeration system 64 in accordance with another embodiment of the invention having multiple evaporators and multiple compressors is illustrated in FIG. 5. In keeping with the operating efficiency and low-cost advantages of the invention, the multiple compressors, the condenser, and the multiple multifunctional valves are contained within a control unit 66. Saturated vapor lines 68 and 70 feed saturated vapor from control unit 66 to evaporators 72 and 74, respectively. Evaporator 72 is located in a first refrigeration case 76, and evaporator 74 is located in a second refrigeration case 78. First and second refrigeration cases 76 and 78 can be located adjacent to each other, or alternatively, at relatively great distance from each other. The exact location will depend upon the particular application. For example, in a retail food outlet, refrigeration cases are typically placed adjacent to each other along an isle way. Importantly, the refrigeration system of the invention is adaptable to a wide variety of operating environments. This advantage is obtained, in part, because the number of components within each refrigeration case is minimal. By avoiding the requirement of placing numerous system components in proximity to the evaporator, the refrigeration system of the invention can be used where space is at a minimum. This is especially advantageous to retail store operations, where floor space is often limited.

In operation, multiple compressors 80 feed heat transfer fluid into an output manifold 82 that is connected to a discharge line 84. Discharge line 84 feeds a condenser 86 and has a first branch line 88 feeding a first multifunctional valve 90 and a second branch line 92 feeding a second multifunctional valve 94. A bifurcated liquid line 96 feeds heat transfer fluid from condenser 86 to first and second multifunctional valves 90 and 94. Saturated vapor line 68 couples first multifunctional valve 90 with evaporator 72, and saturated vapor line 70 couples second multifunctional valve 94 with evaporator 74. A bifurcated suction line 98 couples evaporators 72 and 74 to a collector manifold 100 feeding multiple compressors 80. A temperature sensor 102 is located on a first segment 104 of bifurcated suction line 94 and relays signals to first multifunctional valve 90. A temperature sensor 106 is located on a second segment 108 of bifurcated suction line 98 and relays signals to second multifunctional valve 94.

Those skilled in the art will appreciate that numerous modifications and variations of vapor compression refrigeration system 64 can be made to address different refrigeration applications. For example, more than two evaporators can be added to the system in accordance with the general method illustrated in FIG. 5. Additionally, more condensers and more compressors can also be included in the refrigeration system to further increase the cooling capability.

Figure 6:
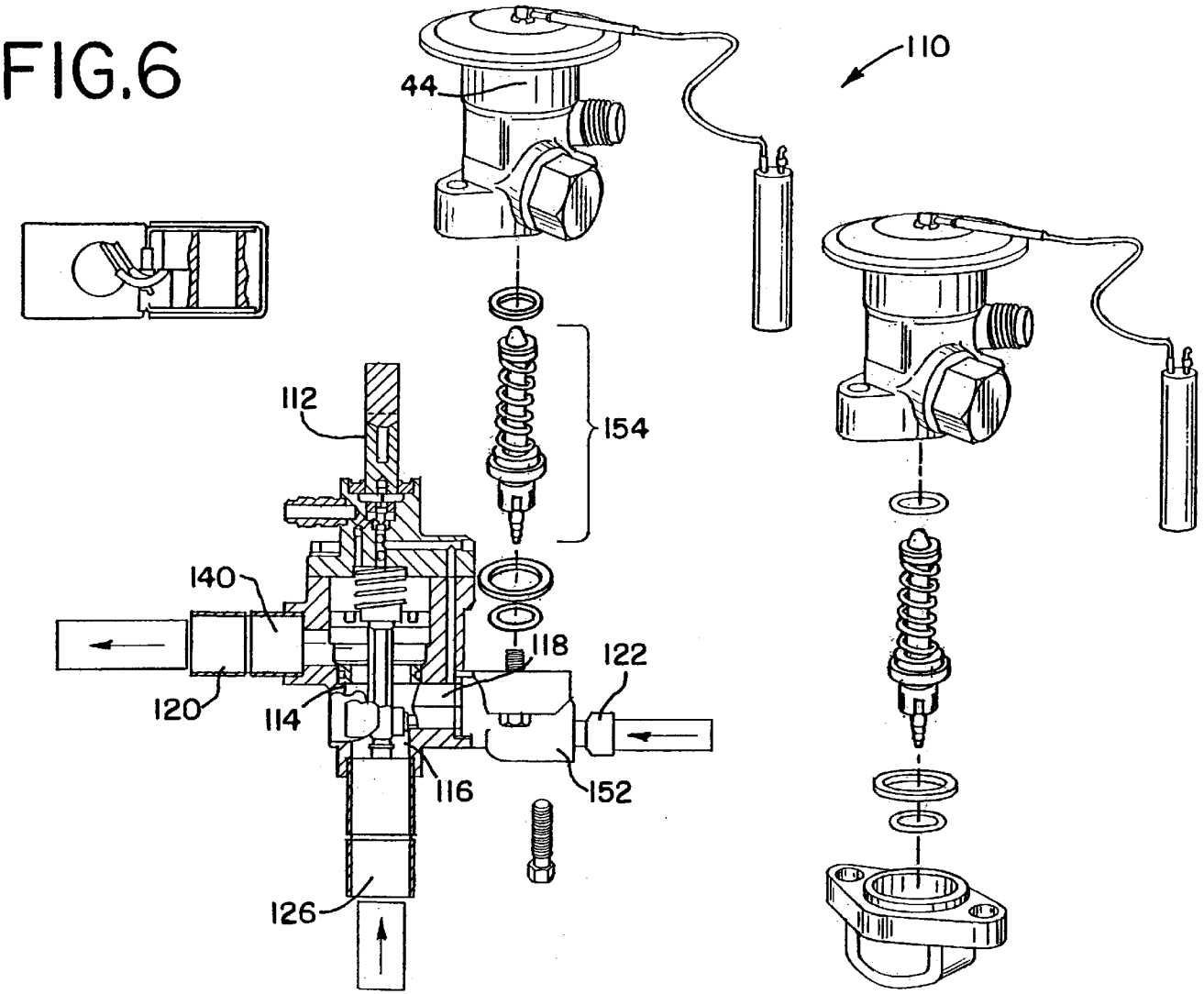
FIG. 6 is an exploded view of the multifunction valve in accordance with another embodiment of the invention.

A multifunctional valve 110 arranged in accordance with another embodiment of the invention is illustrated in FIG. 6. In similarity with the previous multifunctional valve embodiment, the heat transfer fluid exiting the condenser in the liquid state enters a first inlet 122 and expands in expansion chamber 152. The flow of heat transfer fluid is metered by valve assembly 154. In the present embodiment, a solenoid valve 112 has an armature 114 extending into a common seating area 116. In refrigeration mode, armature 114 extends to the bottom of common seating area 116 and cold refrigerant flows through a passageway 118 to a common chamber 140, then to an outlet 120. In defrost mode, hot vapor enters second inlet 126 and travels through common seating area 116 to common chamber 140, then to outlet 120. Multifunctional valve 110 includes a reduced number of components, because the design is such as to allow a single gating valve to control the flow of hot vapor and cold vapor through the valve.

In yet another embodiment of the invention, the flow of liquefied heat transfer fluid from the liquid line through the multifunctional valve can be controlled by a check valve positioned in the first passageway to gate the flow of the liquefied heat transfer fluid into the saturated vapor line. The flow of heat transfer fluid through the refrigeration system is controlled by a pressure valve located in the suction line in proximity to the inlet of the compressor. Accordingly, the various functions of a multifunctional valve of the invention can be performed by separate components positioned at different locations within the refrigeration system. All such variations and modifications are contemplated by the present invention.

Those skilled in the art will recognize that the vapor compression system and method described herein can be implemented in a variety of configurations. For example, the compressor, condenser, multifunctional valve, and the evaporator can all be housed in a single unit and placed in a walk-in cooler. In this application, the condenser protrudes through the wall of the walk-in cooler and ambient air outside the cooler is used to condense the heat transfer fluid.

In another application, the vapor compression system and method of the invention can be configured for air-conditioning a home or business. In this application, a defrost cycle is unnecessary since icing of the evaporator is usually not a problem.

In yet another application, the vapor compression system and method of the invention can be used to chill water. In this application, the evaporator is immersed in water to be chilled. Alternatively, water can be pumped through tubes that are meshed with the evaporator coils.

In a further application, the vapor compression system and method of the invention can be cascaded together with another system for achieving extremely low refrigeration temperatures. For example, two systems using different heat transfer fluids can be coupled together such that the evaporator of a first system provide a low temperature ambient. A condenser of the second system is placed in the low temperature ambient and is used to condense the heat transfer fluid in the second system.

Without further elaboration it is believed that one skilled in the art can, using the preceding description, utilize the invention to its fullest extent. The following examples are merely illustrative of the invention and are not meant to limit the scope in any way whatsoever.

EXAMPLE I

A 5-ft (1.52 m) Tyler Chest Freezer was equipped with a multifunctional valve in a refrigeration circuit, and a standard expansion valve was plumbed into a bypass line so that the refrigeration circuit could be operated as a conventional refrigeration system and as an XDX refrigeration system arranged in accordance with the invention. The refrigeration circuit described above was equipped with a saturated vapor line having an outside tube diameter of about 0.375 inches (0.953 cm) and an effective tube length of about 10 ft (3.048 m). The refrigeration circuit was powered by a Copeland hermetic compressor by compressor having a capacity of about ⅓ tar (338 kg) of refrigeration a sensing bulb was attached to the suction line about 18 inches from the compressor. The circuit was charged with about 28 oz. (792 g) of R-12 refrigerant available from The DuPont Company. The refrigeration circuit was also equipped with a bypass line extending from the compressor discharge line to the saturated vapor line for forward-flow defrosting (See FIG. 1). All refrigerated ambient air temperature measurements were made using a "CPS Date Logger" by CPS temperature sensor located in the center of the refrigeration case, about 4 inches (10 cm) above the floor.

XDX System—Medium Temperature Operation

The nominal operating temperature of the evaporator was 20° F. (6.7° C.) and the nominal operating temperature of the condenser was 120° F. (48.7° C.). The evaporator handled a cooling load of about 3000 Btu/hr (21 g cal/s) and the compressor pumped about 1.0 lbs/min (0.454 kg/min) of refrigerant to the condenser. The multifunctional valve metered about 2609 ft/min (7.95 m/min) of refrigerant into the saturated vapor line at a temperature of about 20° F. (6.7° C.), and a pressure of about 36 lbs/in$^2$ (24,814 n/m$^2$), having a vapor density of about 0.9 lbs/ft$^3$ (14.4 kg/m$^3$). The sensing bulb was set to maintain about 25° F. (3.9° C.) superheating of the vapor flowing in the suction line. The compressor discharged about 2199 ft/min (670 m/min) of pressurized refrigerant into the discharge line at a temperature of about 120° F. (48.9° C.), and a pressure of about 172 lbs/in$^2$ (118,560 N/m$^2$), and having a vapor density of about 3.5 lbs/ft$^3$ (56 kg/m$^3$).

XDX System—Low Temperature Operation

The nominal operating temperature of the evaporator was −5° F. (20.5° C.) and the nominal operating temperature of the condenser was 115° F. (46.1° C.). The evaporator handled a cooling load of about 3000 Btu/hr (21 g cal/s) and the compressor pumped about 1.0 lbs/min (0.454 kg/min) of refrigerant to the condenser. The multifunctional valve metered about 2975 ft/min (907 km/min) of refrigerant into the saturated vapor line at a temperature of about −5° F. (20.5° C.) and a pressure of about 21 lbs/in$^2$ (14475 N/m$^2$), and having a vapor density of about 36 lbs/ft$^3$ (577 kg/m$^3$). The sensing bulb was set to maintain about 20° F. (11.1° C.) superheating of the vapor flowing in the suction line. The compressor discharged about 2299 ft/min (701 m/min) of pressurized refrigerant into the discharge line at a temperature of about 115° F. (46.1° C.), and a pressure of about 161 lbs/in$^2$ (110,977 N/m$^2$), and having a vapor density of about 3.2 lbs/ft$^3$ (51 kg/m$^3$). The XDX system was operated substantially the same in low temperature operation as in medium temperature operation with the exception that the fans in the Tyler Chest Freezer were delayed for 4 minutes following defrost to remove heat from the evaporator coil and to allow water drainage from the coil.

The XDX refrigeration system was operated for a period of about 24 hours at medium temperature operation and about 18 hours at low temperature operation. The temperature of the ambient air within the Tyler Chest Freezer was measured about every minute during the 23 hour testing period. The air temperature was measured continuously during the testing period, while the refrigeration system was operated in both refrigeration mode and in defrost mode. During defrost cycles, the refrigeration circuit was operated in defrost mode until the sensing bulb temperature reached about 50° F. (−10° C.). The temperature measurement statistics appear in Table I below.

Conventional System—Medium Temperature Operation With Reverse-Flow Defrost

The Tyler Chest Freezer described above was equipped with a bypass line extending between the compressor discharge line and the suction line for reverse-flow defrosting. The bypass line was equipped with a solenoid valve to gate the flow of high temperature refrigerant in the line. A bypass check valve and an accumulator were installed to receive the cool refrigerant discharged by the evaporator during defrosting, which was returned to the suction line. A standard expansion valve was installed immediately adjacent to the evaporator inlet and the temperature sensing bulb was attached to the suction line immediately adjacent to the evaporator outlet. The sensing bulb was set to maintain about 6° F. (3.33° C.) superheating of the vapor flowing in the suction line. Prior to operation, the system was charged with about 48 oz. (1.36 kg) of R-12 refrigerant.

The conventional refrigeration system was operated for a period of about 24 hours at medium temperature operation. The temperature of the ambient air within the Tyler Chest Freezer was measured about every minute during the 24 hour testing period. The air temperature was measured continuously during the testing period, while the refrigeration system was operated in both refrigeration mode and in reverse-flow defrost mode. During defrost cycles, the refrigeration circuit was operated in defrost mode until the sensing bulb temperature reached about 50° F. (−10° C.). The temperature measurement statistics appear in Table I below.

Conventional System—Medium Temperature Operation With Air Defrost

The Tyler Chest Freezer described above was equipped with a receiver to provide proper liquid supply to the expansion valve and a liquid line dryer was installed to allow for additional refrigerant reserve. The expansion valve and the sensing bulb were positioned at the same locations as in the reverse-flow defrost system described above. The sensing bulb was set to maintain about 8° F. (4.4° C.) superheating of the vapor flowing in the suction line. Prior to operation, the system was charged with about 34 oz. (0.966 kg) of R-12 refrigerant.

The conventional refrigeration system was operated for a period of about 24 ½ hours at medium temperature operation. The temperature of the ambient air within the Tyler Chest Freezer was measured about every minute during the 24 ½ hour testing period. The air temperature was measured continuously during the testing period, while the refrigeration system was operated in both refrigeration mode and in air defrost mode. In accordance with conventional practice, four defrost cycles were programmed with each lasting for about 36 to 40 minutes. The temperature measurement statistics appear in Table I below.

TABLE I

REFRIGERATION TEMPERATURES (° F./° C.)

| | XDX[1] Medium Temperature | XDX[1] Low Temperature | Conventional[2] Reverse-Flow Defrost | Conventional[2] Air Defrost |
|---|---|---|---|---|
| Average | 38.7/3.7 | 4.7/15.2 | 39.7/4.3 | 39.6/4.2 |
| Standard Deviation | 0.8 | 0.8 | 4.1 | 4.5 |
| Variance | 0.7 | 0.6 | 16.9 | 20.4 |
| Range | 7.1 | 7.1 | 22.9 | 26.0 |

[1]one defrost cycle during 23 hour test period
[2]three defrost cycles during 24 hour test period As illustrated above, the XDX refrigeration system arranged in accordance with the invention maintains a desired the temperature within the chest freezer with less temperature variation than the conventional systems. The standard deviation, the variance, and the range of the temperature measurements taken during the testing period are substantially less than the conventional systems. This result holds for operation of the XDX system at both medium and low temperatures.

During defrost cycles, the temperature rise in the chest freezer was monitored to determine the maximum temperature within the freezer. This temperature should be as close to the operating refrigeration temperature as possible to avoid spoilage of food products stored in the freezer. The maximum defrost temperature for the XDX system and for the conventional systems is shown in Table II below.

TABLE II

MAXIMUM DEFROST TEMPERATURE (° F./° C.)

| XDX Medium Temperature | Conventional Reverse-Flow Defrost | Conventional Air Defrost |
|---|---|---|
| 44.4/6.9 | 55.0/12.8 | 58.4/14.7 |

EXAMPLE II

The Tyler Chest Freezer was configured as described above and further equipped with electric defrosting circuits. The low temperature operating test was carried out as described above and the time needed for the refrigeration unit to return to refrigeration operating temperature was measured. A separate test was then carried out using the electric defrosting circuit to defrost the evaporator. The time needed for the XDX system and an electric defrost system to complete defrost and to return to the 5° F. (15.0° C.) operating set point appears in Table III below.

TABLE III

TIME NEEDED TO RETURN TO REFRIGERATION TEMPERATURE OF 5° F. (15° C.) FOLLOWING

| | XDX | Conventional System with Electric Defrost |
|---|---|---|
| Defrost Duration (min) | 10 | 36 |
| Recovery Time (min) | 24 | 144 |

As shown above, the XDX system using forward-flow defrost through the multifunctional valve needs less time to completely defrost the evaporator, and substantially less time to return to refrigeration temperature.

Thus, it is apparent that there has been provided, in accordance with the invention, a vapor compression refrigeration system that fully provides the advantages set forth above. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. For example, non-halogenated refrigerants can be used, such as ammonia, and the like can also be used. It is therefore intended to include within the invention all such variations and modifications that fall within the scope of the appended claims and equivalents thereof.

What is claimed is:

1. A vapor compression system comprising:

a compressor for increasing the pressure and temperature of a heat transfer fluid;

a condenser for liquefying the heat transfer fluid;

an evaporator for transferring heat from ambient surroundings to the heat transfer fluid;

a multifunctional valve having a first inlet and a second inlet and an outlet;

a saturated vapor line connecting the outlet of the multifunctional valve to the inlet of the evaporator;

a liquid line connecting the condenser to the first inlet of the multifunctional valve;

a discharge line connecting the compressor to the second inlet of the multifunctional valve;

a suction line connecting the evaporator to the compressor; and a temperature sensor mounted to the suction line and operatively connected to the multifunctional valve, wherein the saturated vapor line is of sufficient length to vaporize a substantial portion of the heat transfer fluid before the heat transfer fluid enters the evaporator.

2. The vapor compression system of claim 1, wherein the multifunctional valve comprises:

a first passageway coupled to the first inlet, the first passageway gated by a first solenoid valve;

a second passageway coupled to the second inlet, the second passageway gated by a second solenoid valve; and a mechanical metering valve positioned in the first passageway and activated by the temperature sensor.

3. The vapor compression system of claim 1, further comprising a unit enclosure and a refrigeration case, wherein the compressor, condenser, multifunctional valve, and temperature sensor are located within the unit enclosure, and wherein the evaporator is located within the refrigeration case.

4. The vapor compression system of claim 1, wherein the compressor comprises a plurality of compressors each coupled to the suction line by an input manifold and each discharging into a collector manifold connected to the discharge line.

5. The vapor compression system of claim 1 further comprising:

a plurality of evaporators;

a plurality of multifunctional valves;

a plurality of saturated vapor lines, wherein each saturated vapor line connects one of the plurality of multifunctional valves to one of the plurality of evaporators;

a plurality of suction lines, wherein each suction line connects one of the plurality of evaporators to the compressor, wherein each of the plurality of suction lines has a temperature sensor mounted thereto for relaying a signal to a selected one of the plurality of multifunctional valves.

6. A vapor compression system comprising:

an evaporator;

a compressor configured to receive a heat transfer fluid from the evaporator and to discharge the a heat transfer fluid at relatively high temperature and pressure;

a condenser configured to receive the heat transfer fluid from the compressor at an inlet and to discharge the heat transfer fluid in a liquid state;

a multifunctional valve configured to receive the heat transfer fluid in the liquid state at a first inlet and in the vapor state at a second inlet, wherein the multifunctional valve includes a first passageway coupled to the first inlet, the first passageway having a metering valve positioned therein and gated by a first valve, and a second passageway coupled to the second inlet and gated by a second valve, and a common chamber, and wherein the first and second passageways terminate at the common chamber;

a liquid line connected to the condenser and to the first inlet of the multifunctional valve; and a bifurcated discharge line connected to the compressor and having a first portion connected to the condenser and a second portion connected to the second inlet of the multifunctional valve.

7. The vapor compression system of claim 6, wherein the first and second valves comprise solenoid valves.

8. The vapor compression system of claim 6 further comprising a suction line connecting the evaporator to the compressor and a pressure regulating valve positioned in the suction line, and wherein the first valve in the multifunctional valve comprises a check valve.

9. The vapor compression system of claim 6 further comprising a suction line connecting the evaporator to the compressor and a temperature sensor mounted to the suction line and operably connected to the multifunctional valve.

10. The vapor compression system of claim 6 further comprising:

a plurality of evaporators;

a plurality of multifunctional valves;

a plurality of saturated vapor lines, wherein each saturated vapor line connects one of the plurality of multifunctional valves to one of the plurality of evaporators; and a plurality of suction lines, wherein each suction line connects one of the plurality of evaporators to the compressor, wherein each of the plurality of suction lines has a temperature sensor mounted thereto for relaying a signal to a selected one of the plurality of multifunctional valves.

11. A method for operating a vapor compression system comprising:

providing a multifunctional valve including a first inlet for receiving a heat transfer fluid in the liquid state, a second inlet for receiving the heat transfer fluid in the gaseous state, a first passageway coupling the first inlet to a common chamber, the first passageway having a metering valve positioned therein and gated by a first valve, and a second passageway coupling the second inlet to the common chamber, the second passageway gated by a second valve;

compressing the heat transfer fluid to a relatively high temperature and pressure and flowing the heat transfer fluid through a first discharge line to a condenser and through a second discharge line to the second inlet of the multifunctional valve through the first pathway in the multifunctional valve;

flowing the heat transfer fluid from the condenser through a liquid line to the first inlet of the multifunctional valve, wherein the heat transfer fluid undergoes volumetric expansion at the metering valve;

collecting the heat transfer fluid in the common chamber and flowing the heat transfer fluid through a saturated vapor line to an evaporator, wherein the flow rate of the heat transfer fluid in the saturated vapor line and the length of the saturated vapor line between the multifunctional valve and the evaporator is sufficient to vaporize a substantial portion of the heat transfer fluid to form a saturated vapor before the heat transfer fluid enters the evaporator, wherein the saturated vapor substantially fills the evaporator, and wherein heat is transferred to the saturated vapor from the ambient surroundings; and returning the saturated vapor to the compressor through a suction line.

12. The method of claim 11, wherein a process for defrosting the evaporator comprises closing the first valve and opening the second valve in the multifunctional valve to stop the flow of heat transfer fluid in the first passageway and to initiate the flow of the heat transfer fluid from the compressor to the common chamber through the second passageway.

13. The method of claim 11, wherein flowing the heat transfer to the saturated vapor line comprises:

measuring the temperature of the heat transfer fluid in the suction line at a point in close proximity to the compressor; and relaying a signal to the multifunctional valve to actuate the metering valve.

14. The method of claim 11, further comprising flowing about 3 to about 5 lbs/min (1.36 to 2.27 kg/min) of heat transfer fluid, wherein the heat transfer fluid comprises a fluid selected from the group consisting of R-12 and R-22.

15. The method of claim 14, wherein the evaporator is sized to handle about a cooling load of about 12000 Btu/hr (84 g cal/s).

16. The method of claim 14, wherein the heat transfer fluid flows through the saturated vapor line at a rate of about 2500 (76 m/min) to about 3700 ft/min (1128 m/min).

17. A vapor compression system for transferring heat from an ambient atmosphere by flowing a heat transfer fluid comprising:

a compressor;

a condenser;

a discharge line coupling the compressor to the condenser;

an evaporator;

a suction line coupling the evaporator to the compressor;

a multifunctional valve;

a liquid line coupling the condenser to the multifunctional valve; and a saturated vapor line coupling the multifunctional valve to the evaporator, wherein the saturated vapor line is characterized by a diameter and by a length, and wherein the diameter and the length is sufficient to substantially convert the heat transfer fluid into a saturated vapor prior to delivery to the evaporator.

18. The vapor compression system of claim 17, wherein the multifunctional valve comprises a first expansion chamber and a second expansion chamber and a passageway coupling the first expansion chamber to the second expansion chamber, such that liquefied heat transfer fluid undergoes a first volumetric expansion in the first expansion chamber and a second volumetric expansion in the second expansion chamber.

19. The vapor compression system of claim 18, wherein the diameter and the length of the saturated vapor line are sufficient to substantially convert about 3 to 5 lbs/min (1.36 to 2.27 kg/min) of R-12 to a saturated vapor.

20. The vapor compression system of claim 18, wherein the multifunctional valve further comprises a second passageway coupling the discharge line from the compressor to the saturated vapor line, and a gate valve positioned in the second passageway such that hot vapor from the compressor can flow to the saturated vapor line when the gate valve is opened.

21. A multifunctional valve for generating a substantially saturated vapor comprising:

an inlet providing fluid ingress to a first expansion chamber;

an outlet providing fluid egress from a second expansion chamber;

a passageway interconnecting the first expansion chamber and the second expansion chamber;

a gate valve positioned in the passageway intermediate to the first expansion chamber and the second expansion chamber; and an expansion valve positioned in the first expansion chamber passageway adjacent to the inlet.

22. The multifunctional valve of claim 21, wherein the expansion valve further comprises a valve assembly having a portion protruding into the passageway for regulating the amount of fluid entering the first expansion chamber.

23. The multifunctional valve of claim 21, wherein the gate valve comprises a solenoid valve.

24. The multifunctional valve of claim 21, wherein the first expansion chamber and the second expansion chamber and the passageway coupling the first expansion chamber to the second expansion chamber are arranged such that a liquefied heat transfer fluid entering the first expansion chamber undergoes a first volumetric expansion in the first expansion chamber and a second volumetric expansion in the second expansion chamber and exits the second expansion chamber as a substantially saturated vapor.

25. The multifunctional valve of claim 21 further comprising:

a second inlet;

a second passageway coupling the second inlet to the second expansion chamber; and a second gating valve positioned in the second passageway.

26. A multifunctional valve for generating a substantially saturated vapor comprising:

a valve body housing a common chamber and a passageway connected to the common chamber, the common chamber having an outlet for discharging a substantially saturated vapor;

an expansion chamber connected to the valve body, the expansion chamber having an inlet at a first end for receiving a liquefied heat transfer fluid and an outlet at a second end coupled to the passageway; and an expansion valve positioned in the expansion chamber adjacent to the inlet, the expansion valve having a valve assembly protruding into the passageway for regulating the flow of liquefied heat transfer fluid into the expansion chamber.

27. The multifunctional valve of claim 26 further comprising a tube having an inlet end coupled to the second end of the expansion chamber and an outlet end partially inserted into the passageway in the valve body.

28. The multifunctional valve of claim 26 further comprising a gate valve positioned in the passageway intermediate to the expansion chamber and the common chamber.

29. The multifunctional valve of claim 28 further comprising:

a second inlet in the valve body;

a second passageway in the valve body coupling the second inlet to the common chamber; and a second gating valve positioned in the second passageway.

30. The multifunctional valve of claim 29, wherein the second inlet and the second passageway are configured to receive a high pressure vapor and transfer the high pressure vapor to the common chamber.

31. In a vapor compression system including a compressor receiving a heat transfer fluid through a suction line and connected to a condenser discharging the heat transfer fluid through a liquid line, a system for generating a substantially saturated vapor comprising:

first means for receiving a heat transfer fluid as a substantially pressurized liquid;

means for vaporizing at least a portion of the pressurized liquid to form a saturated vapor;

means for regulating the flow of the heat transfer fluid through means for vaporizing;

means for collecting the heat transfer fluid;

a first passage way providing fluid flow from the means for vaporizing to the means for collecting;

means in the first passageway for terminating the flow of heat transfer fluid therethrough;

second means for receiving the heat transfer fluid as a high-pressure vapor;

a second passage way providing fluid flow from the second means to the means for collecting; and means in the second passageway for terminating the flow of heat transfer fluid therethrough, wherein the means for collecting is configured to discharge the heat transfer fluid received through the first passageway as a substantially saturated vapor, and is configured to discharge the heat transfer fluid received through the second passageway as a high pressure vapor.

32. The device of claim 31, wherein the means in the first passageway and the means in the second passageway for terminating the flow of heat transfer fluid comprise solenoid valves.

33. The device of claim 31, wherein the means in the first passageway for terminating the flow of heat transfer fluid comprise a check valve positioned in the liquid line.

34. The device of claim 31, wherein the means for regulating comprises a thermally responsive element positioned in the means for vaporizing.

35. The device of claim 31, wherein the means for regulating comprises a pressure valve located in the suction line.

36. A system for receiving a heat transfer fluid through either a liquid line or a condenser bypass line and for discharging the heat transfer fluid as either a substantially saturated vapor or as a highly pressurized vapor comprising:

a first chamber, the first chamber having a first inlet for receiving a liquefied heat transfer fluid;

a second chamber;

a first passageway interconnecting the first chamber and the second chamber;

a second passageway connected to the second chamber for providing the flow of a highly pressurized heat transfer fluid to the second chamber;

a thermally responsive element configured to regulate the flow of heat transfer fluid through the first chamber;

a first gating valve operable to terminate the flow of heat transfer fluid through the first passageway;

a second gating valve operable to terminate the flow of heat transfer fluid through the second passageway; and an outlet in the second chamber for discharging the heat transfer fluid received from the first chamber as a substantially saturated vapor and discharging the heat transfer fluid received through the second passageway as a high pressure vapor.

37. The system of claim 36, wherein the thermally responsive element comprises a pressure valve positioned in the liquid line.

38. The system of claim 36, wherein the thermally responsive element comprises an expansion valve positioned in the first chamber.

39. The system of claim 36, wherein the first gating valve comprises a check valve positioned in the first passageway.

40. The system of claim 36, wherein the first gating valve comprises a solenoid valve positioned in the first passageway.

41. A vapor compression system for transferring heat from an ambient atmosphere by flowing a heat transfer fluid comprising:

a compressor;

a condenser;

a discharge line coupling the compressor to the condenser;

an evaporator;

a suction line coupling the evaporator to the compressor;

a multifunctional valve;

a liquid line coupling the condenser to the multifunctional valve; and a saturated vapor line coupling the multifunctional valve to the evaporator, wherein the multifunctional valve is positioned in close proximity to the condenser, the saturated vapor line is of relatively great length in relation to the liquid line, the saturated vapor line is characterized by a diameter and by a length, and the diameter and the length is sufficient to substantially convert the heat transfer fluid into a saturated vapor prior to delivery to the evaporator.

* * * * *